US011644222B2

(12) United States Patent
Lee

(10) Patent No.: US 11,644,222 B2
(45) Date of Patent: May 9, 2023

(54) ELECTROMAGNETIC COOLING AND HEATING

(71) Applicant: Choon Sae Lee, Dallas, TX (US)

(72) Inventor: Choon Sae Lee, Dallas, TX (US)

( * ) Notice: Subject to any disclaimer, the term of this patent is extended or adjusted under 35 U.S.C. 154(b) by 330 days.

(21) Appl. No.: 16/938,958

(22) Filed: Jul. 25, 2020

(65) Prior Publication Data

US 2022/0026119 A1 Jan. 27, 2022

(51) Int. Cl.
*F25B 27/00* (2006.01)

(52) U.S. Cl.
CPC ..... *F25B 27/005* (2013.01)

(58) Field of Classification Search
CPC ..... F25B 27/005; F25B 27/00; F28D 15/00; F28D 17/00; F28D 19/00; F28D 20/00
USPC ..... 62/238.7
See application file for complete search history.

(56) References Cited

U.S. PATENT DOCUMENTS 4,346,569 A * 8/1982 Yuan ..... F28D 20/0043 165/104.11
4,700,716 A * 10/1987 Kasevich ..... A61B 18/18 607/156
5,105,200 A * 4/1992 Koepf ..... H01Q 1/364 333/263
2006/0207442 A1* 9/2006 Pettersson ..... H02J 50/27 99/517
2007/0001910 A1* 1/2007 Yamanaka ..... H01Q 13/02 343/700 MS
2010/0101762 A1* 4/2010 Kroliczek ..... F28D 15/043 165/104.26
2020/0195302 A1* 6/2020 Vannucci ..... H01B 11/1895
2020/0381842 A1* 12/2020 Milroy ..... H01Q 3/04

FOREIGN PATENT DOCUMENTS

JP H02186599 A * 7/1990

* cited by examiner

*Primary Examiner* — Justin M Jonaitis
(74) *Attorney, Agent, or Firm* — Jack D. Stone, Jr.

(57) ABSTRACT

A system for electromagnetically transferring heat from one region to another region. To cool one region in a chamber, antennas in the chamber to be cooled preferably have a broad beam to collect thermal radiation as much as possible within the chamber. Antennas to be used for heat pumping are preferably of high directivity where the antenna beam is pointed to a cold region such as the zenith of the sky. The system for electromagnetic heating is similar to that for electromagnetic cooling except heat flow is reversed. Here, the antennas outside a chamber have a highly focused beam to a hot area, such as the sun. The collected heat is channeled into an area to be heated by low-directivity antennas within an enclosed volume to be heated.

19 Claims, 2 Drawing Sheets

ELECTROMAGNETIC COOLING AND HEATING

CROSS-REFERENCES TO RELATED APPLICATIONS

This application claims the benefit of U.S. Provisional Application No. 62/879,097 filed Jul. 26, 2019, which is hereby incorporated herein by reference, in its entirety.

TECHNICAL FIELD

The invention relates generally to cooling and heating, and more particularly, to a system for electromagnetic cooling and heating.

BACKGROUND

In currently available cooling systems, as in refrigerators or AC units, a refrigerant is usually circulated with an electric pump, where the refrigerant takes heat from an enclosed area and releases it to the outside. In such an operation process, substantial electric power is consumed. When heat flow is reversed, the resultant system becomes a heat pump that heats a designated area, also requiring substantial electric power as well.

Therefore, what is needed is an apparatus and method for cooling and heating without external power sources.

SUMMARY

In the proposed device, the cooling process is all passive and no electric power is needed to cool the area in an enclosed volume.

In accordance with principles of the invention, thermal energy is transferred from a hot region to a cold region via an electromagnetic device. For example, the cold temperature outside earth's atmosphere ("space") can be utilized to pump heat from an enclosed volume on earth to the outer space. A relatively simple system of low cost at mass production can be made to do this. The system can be used for air-conditioning (AC) systems. With a proper design, it is possible to facilitate fast cooling analogous to rapid heating of food stuff achieved by a conventional microwave oven.

It is also possible to produce efficient heating by reversing the heat flow in the opposite direction compared to that in the cooling system.

An antenna is a device that takes power from an electromagnetic wave as a receiver while it can also be used as a transmitter of electromagnetic power. Depending on its surrounding area, an antenna can take thermal electromagnetic power at an infrared spectrum as well. The amount of thermal power radiated by an object is characterized by a black-body radiation temperature. When a high-gain antenna, such as a reflector antenna, points to the ground, the amount of power collected by the antenna is similar to that from a black body of the ground temperature. However, when the main beam is directed to the zenith of the sky, the power received by the antenna will be much smaller due to the fact that the radiation temperature of the open sky is substantially low, usually less than the freezing point of water.

A transmission line connects two antenna systems to transport electromagnetic power from a high-temperature area to a low-temperature region for electromagnetic cooling. In the antenna and transmission-line designs, there are two required conditions to make these antennas effective in electromagnetic cooling:

The transmission line has to be designed to reduce any added thermal power while electromagnetic waves propagate within the waveguide transmission line connecting two antennas at the ends of the transmission line. Metallic surfaces are convenient for antenna and transmission-line designs. However, metallic surfaces substantially add thermal power to the antennas and transmission line. Thus, it is recommended to have all dielectric antennas and transmission lines at frequencies of thermal agitation.

An antenna inside a region where heat is to be pumped to be cooled must have a broad beam to collect most of the electromagnetic power regardless of the incident angle, but an antenna outside the region must be highly directional or of high gain so that the antenna beam is pointed to a location of low effective temperature, such as the zenith of the sky.

Since the electromagnetic fields need to be confined within the dielectric transmission line, a cladding will reduce interaction with thermal agitation from the surrounding area. Also, a circular shape is easier to fabricate, as in optical fibers. The antenna at the tip of the transmission line can be tapered so that the electromagnetic power leaks out as the wave travels to the end without much reflection over a wide frequency range of the infrared spectrum.

The above system may also be used for heating when the chamber is colder than the region in the outside. In other words, the high-gain antenna should be pointed to the region where heat is coming from, such as the sun, and the low-gain antenna should be pointed to the region to be heated. Otherwise, the operation principles for cooling and heating remain the same.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
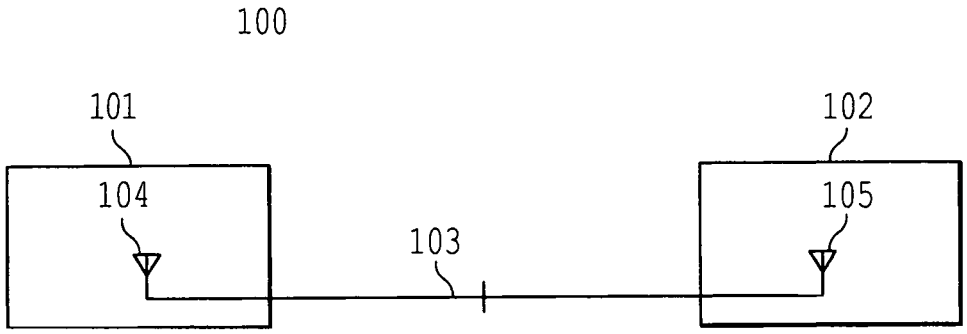
FIG. 1 is a schematic diagram exemplifying one embodiment for a chamber to be cooled and a chamber from which heat is dissipated, antennas in the two chambers that are connected by a transmission line, and a dielectric rod with a core and cladding region for the transmission line, in accordance with principles of one embodiment of the invention.

FIG. 1 depicts a system 100 for electromagnetic cooling including a chamber 101 and a chamber 102, that are connected by a transmission line 103, the ends of which are connected to impedance-matched an antenna 104 in chamber 101 and an antenna 105 in the chamber 102. Here, chamber 101 is a region to be cooled and chamber 102 is a region where the effective temperature is small and to which heat is pumped. At the frequency spectrum of thermal excitation, a dielectric transmission line over a metallic waveguide is preferred to reduce added thermal power from conduction losses on the metallic surfaces. Since the electromagnetic fields need to be confined while a wave propagates within the dielectric transmission line, a high dielectric constant of the dielectric transmission line 103 can be used to reduce interference from its surrounding area while a wave propagates within the waveguide structure of the dielectric transmission line 103. To further reduce the interaction with thermal agitation external to the waveguide, a cladding layer is preferably added over a core layer where the dielectric constant of the cladding is slightly less than that of the core. Also, a circular shape is preferred for easy fabrication, such as optical fibers, though other cross-sectional shapes are acceptable.

In the operation of system 100, antenna 104 in chamber 101 has a broad beam so that most of the thermal radiation within chamber 101 is collected by antenna 104 and transmitted to transmission line 103. The transmitted power propagates along transmission line 103 and reaches antenna 105 in chamber 102, where antenna 105 radiates the accepted power from transmission line 103 to a cool region of chamber 102. Both antennas 103 and 104 are preferred to have a relatively large bandwidth to cover most thermal radiation at the temperature of interest. Antennas 104 and 105 are preferably dielectric antennas to increase radiation efficiencies.

Figure 2:
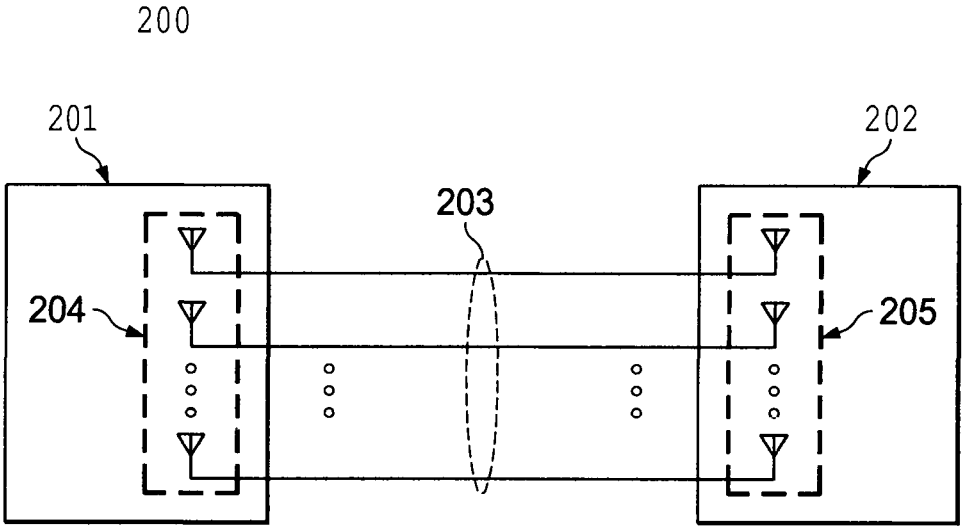
FIG. 2 is a schematic diagram exemplifying an alternative embodiment to that depicted by FIG. 1, wherein more than one pair of antennas and transmission line are employed in accordance with principles of the present invention.

FIG. 2 depicts a system 200 with a number of pairs of the antennas and transmission line that are described in system 100. A set of antennas 204 in a chamber 201 to be cooled have a broad beam and most of the thermal radiation energy in chamber 201 is captured by antennas 204 and transmitted to a set of transmission lines 203. The transmitted power propagates along the set of transmission lines 203 and reaches a set of antennas 205 in a chamber 202 of cold region where heat energy is to be absorbed. There will be net heat flow from chamber 201 to chamber 202, and enclosed chamber 201 will be cooled as long as chamber 202 is colder than chamber 201. The colder chamber 202 is, the faster chamber 201 is cooled. Also, a circular shape is preferred for easy fabrication, such as optical fibers, though other cross-sectional shapes are acceptable.

Figure 3:
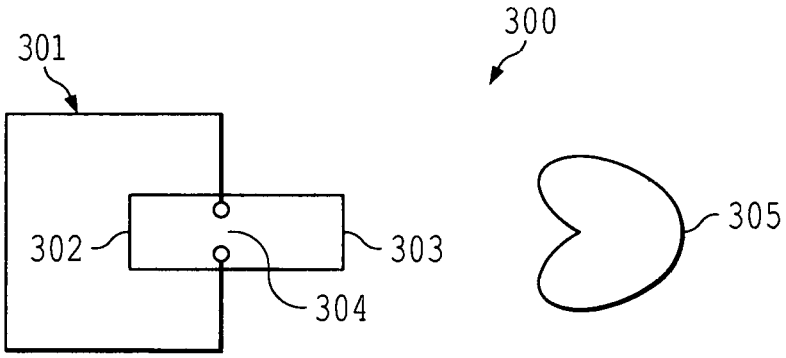
FIG. 3 is a schematic diagram exemplifying an alternative embodiment to that depicted by FIG. 1, wherein the transmission line is removed in accordance with principles of the present invention.

FIG. 3 depicts a system 300 and includes a chamber 301 to be cooled, an antenna 302 inside chamber 301, and an antenna 303 outside chamber 301. Antennas 302 and 303 are connected to each other by an aperture 304 on the wall of chamber 301.

In the operation of system 300, antenna 302 inside chamber 301 has a broad beam so that most of the thermal radiation within chamber 301 is collected by antenna 302 and transmitted to antenna 303 via aperture 304 on the wall of chamber 301. Antenna 303 radiates the accepted power from antenna 302 to a cold region 305 such as the outer space. Antenna 303 preferably has a high gain for the radiated power to be focused to region 305. High-gain antennas include reflector antennas, horn antennas, and lens antennas as well as well-designed dielectric antennas. To increase radiation efficiencies, dielectric antennas can be used. Both antennas 302 and 303 are preferred to have a relatively large bandwidth to cover most radiation at the temperature of interest.

Figure 4:
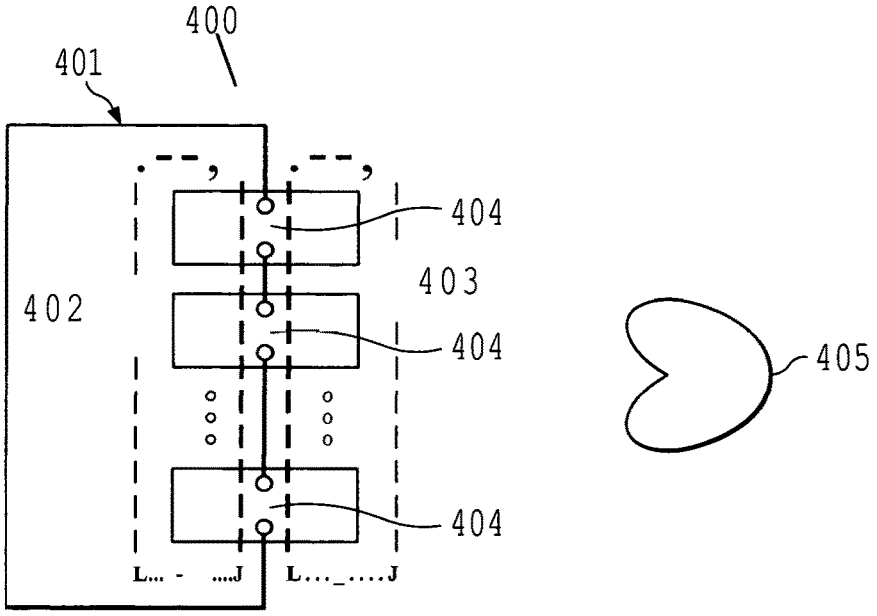
FIG. 4 is a schematic diagram exemplifying an alternative embodiment to that depicted by FIG. 2, wherein the transmission lines are removed in accordance with principles of the present invention.

FIG. 4 depicts a system 400 with a number of pairs of antennas and aperture as described in system 300. A set of antennas 402 inside a chamber 401 to be cooled have a broad beam so that most of the thermal radiation energy in chamber 401 is captured by antennas 402 and transmitted to a set of antennas 403 through apertures 404 on the wall of chamber 401. The set of antennas 403 radiate the accepted power from antennas 402 to a cold region 405, such as the zenith of the sky. In order to focus the electromagnetic beam to a particular location of a cold area 405 where heat energy is absorbed, antennas 403 need to be of high gain. High-gain antennas include reflector antennas, horn antennas, and lens antennas. Properly designed dielectric antennas can be used to increase the radiation efficiency. There will be heat flow from region 405 to chamber 401. However, as long as region 405 is colder than chamber 401, the enclosed chamber 401 will be cooled. The colder region 405 is, the faster chamber 401 will be cooled.

Figure 5:
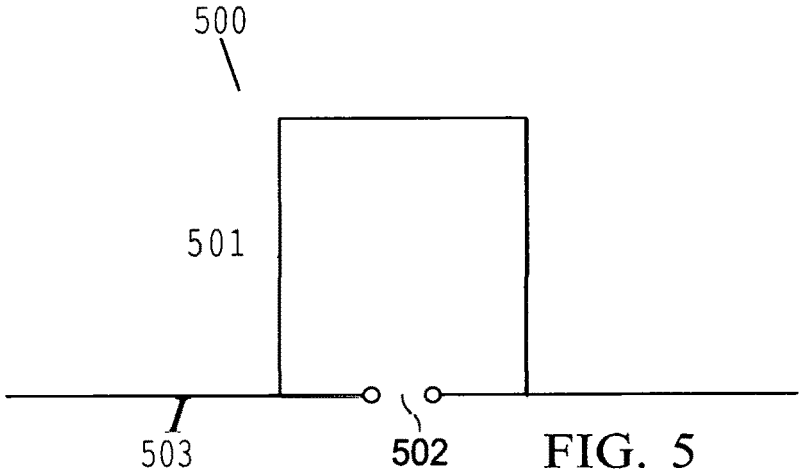
FIG. 5 is a schematic diagram exemplifying one embodiment for a dielectric rod above a conducting plate with an aperture under the dielectric rod to be used for the dielectric antennas in the electromagnetic cooling and heating devices in accordance with principles of the present invention.

FIG. 5 depicts a dielectric antenna 500 and includes a circular cylinder of dielectric rod 501 and a coupling aperture 502 on a conducting plate 503. The antenna is used to transmit electromagnetic power as a transmitter while it is also used to receive radiation power as a receiver.

In the operation of system 500, electromagnetic power is coupled from below conducting plate 503 through coupling aperture 502 to form electromagnetic excitation within antenna 501 that radiates electromagnetic power in a focused beam. With a proper design, the focused beam is in the direction normal to conducting plate 503. The height of the dielectric antenna 501 is varied to change the antenna gain that shows the beam focus of radiated power. A circular cylinder of dielectric rod 501 is preferred for easy fabrication though other shapes are acceptable.

Figure 6:
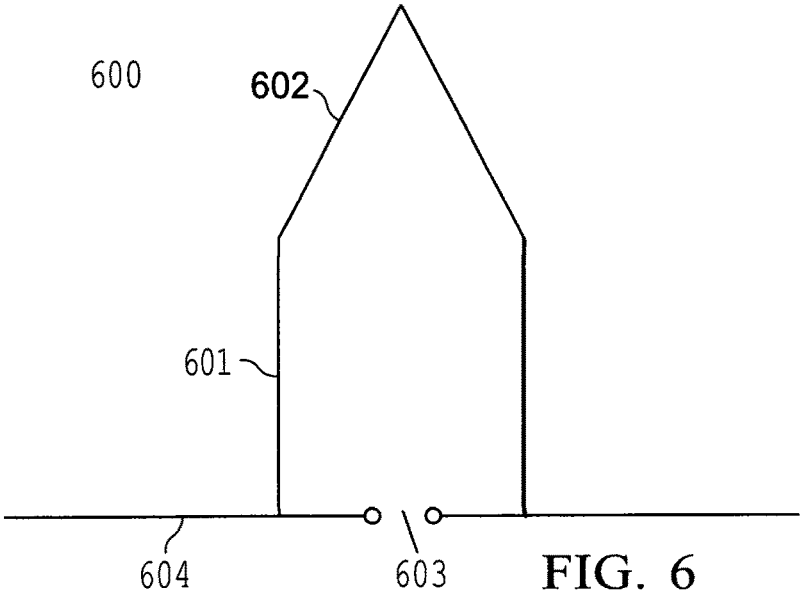
FIG. 6 is a schematic diagram exemplifying an alternative embodiment of use depicted by FIG. 5, wherein a conical dielectric is attached above the cylindrical rod in accordance with principles of the present invention.

FIG. 6 depicts a dielectric antenna 600 of FIG. 5 and includes a dielectric rod 601, a conical dielectric 602 attached to dielectric 601, and a coupling aperture 603 on a conducting plate 604. The operation principle of antenna 600 is the same as that of antenna 500 except that the conical dielectric 602 increases the frequency bandwidth as well as the gain. A circular cylinder of dielectric road and a circular dielectric cone are preferred for easy fabrication though other shapes are acceptable.

The above devices may also be used for heating when the temperature gradient of the two regions is switched. In other words, the high-gain antenna is pointed to the region where heat is coming from, and the low-gain antenna is connected to the region to be heated. Otherwise, the operation principles remain the same.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A system for transferring heat, the system comprising:

one or more transmission lines, each of which transmission lines defines a first end and a second end, wherein the one or more transmission lines are one or more waveguide transmission lines configured to propagate electromagnetic waves from the first end of each respective transmission line to the second end of each respective transmission line;

a first heat reservoir connected to the first end of each of the one or more transmission lines, and wherein a first antenna in the first heat reservoir is connected to the first end of each of the one or more transmission lines through an aperture on the wall of the first heat reservoir; and a second heat reservoir connected to the second end of the one or more transmission lines, wherein a second antenna in the second heat reservoir is connected to the second end of each of the one or more transmission lines through an aperture on the wall of the second heat reservoir, and wherein the first heat reservoir and the second heat reservoir are configured for having a temperature differential between them.

2. The system of claim 1, wherein the first heat reservoir is hotter than the second heat reservoir for cooling the first heat reservoir.

3. The system of claim 1, wherein the first heat reservoir is colder than the second heat reservoir for heating the first heat reservoir.

4. The system of claim 1, wherein each transmission line is a dielectric.

5. The system of claim 1, wherein each transmission line is a dielectric with cladding.

6. The system of claim 1, wherein each antenna in the first heat reservoir is a dielectric antenna.

7. The system of claim 1, wherein each antenna in the first heat reservoir is of low directivity.

8. The system of claim 1, wherein each antenna in the second heat reservoir is a dielectric antenna.

9. The system of claim 1, wherein each antenna in the second heat reservoir is of high directivity.

10. The system of claim 1 wherein the second antenna is a high-gain antenna selected from the group consisting of reflector antennas, horn antennas, and lens antennas.

11. A system for transferring heat, the system comprising:

a chamber;

a region outside the chamber wherein the region has a temperature differential with the chamber;

one or more apertures on the wall of the chamber;

each of one or more antennas inside the chamber is connected to an inside surface of the wall of the chamber, wherein each antenna inside the chamber and each of the one or more apertures on the wall of the chamber are respectively connected; and each of one or more antennas is connected to an outside surface of the wall of the chamber, wherein each antenna outside the chamber and each of the one or more apertures on the wall of the chamber are respectively connected, wherein each antenna outside the chamber is a high-gain antenna selected from the group consisting of reflector antennas, horn antennas, and lens antennas, and wherein each antenna outside the chamber points a beam to the region outside the chamber.

12. The system of claim 11, wherein the chamber is hotter than the region for cooling the chamber.

13. The system of claim 11, wherein the chamber is colder than the region for heating the chamber.

14. The system of claim 11, wherein each antenna inside the chamber is a dielectric antenna.

15. The system of claim 11, wherein each antenna inside the chamber is of low directivity.

16. The system of claim 11, wherein each antenna outside the chamber is a dielectric antenna.

17. The system of claim 11, wherein each antenna outside the chamber is of high directivity.

18. The system of claim 11, wherein the chamber is thermally insulated.

19. The system of claim 11, wherein the chamber is enclosed by a metal.

* * * * *